US006352381B1

(12) United States Patent
Gonmori et al.

(10) Patent No.: US 6,352,381 B1
(45) Date of Patent: Mar. 5, 2002

(54) PRINTER FOR CONTINUOUS PAPER

(75) Inventors: Yoshikazu Gonmori; Hitoshi Sato, both of Tokyo (JP)

(73) Assignee: Japan CBM Corporation, Tokyo (JP)

( * ) Notice: Subject to any disclaimer, the term of this patent is extended or adjusted under 35 U.S.C. 154(b) by 0 days.

(21) Appl. No.: 09/414,493

(22) Filed: Oct. 8, 1999

(30) Foreign Application Priority Data

Oct. 12, 1998 (JP) ..... 10-303200

(51) Int. Cl.[7] ..... B41J 15/20
(52) U.S. Cl. ..... 400/615.2; 400/621
(58) Field of Search ..... 400/615.2, 621, 400/615, 614.1, 621.2, 611, 693, 613, 642, 645.5, 647.1; 101/219, 226, 224, 227

(56) References Cited

U.S. PATENT DOCUMENTS 4,592,669 A * 6/1986 Lohse et al. ..... 400/621
4,641,980 A * 2/1987 Matsumoto et al. ..... 400/120
5,244,295 A * 9/1993 Terashima et al. ..... 400/639
5,490,735 A * 2/1996 Brandenburg et al. ..... 400/614
5,713,679 A * 2/1998 Taylor ..... 400/621
5,727,889 A * 3/1998 Koyabu ..... 400/621
5,779,371 A * 7/1998 Aoyama et al. ..... 200/120.6
5,988,903 A * 11/1999 Baitz et al. ..... 400/605
5,993,093 A * 11/1999 Schoennauer et al. ..... 400/621
6,022,158 A * 2/2000 Nakayama et al. ..... 400/613
6,030,133 A * 2/2000 Endo ..... 400/82

* cited by examiner

*Primary Examiner*—Ren Yan
*Assistant Examiner*—Darius Cone
(74) *Attorney, Agent, or Firm*—Dennison, Scheiner, Schultz & Wakeman

(57) ABSTRACT

A paper holding portion is provided in a printer body for holding paper, a print head is provided in the printer body adjacent a paper cutter, and a platen roller is rotatably mounted on the printer body and contacted with the print head. A pressure roller is rotatably mounted on a cover so as to be pressed against the platen roller when the cover is closed.

6 Claims, 10 Drawing Sheets

PRINTER FOR CONTINUOUS PAPER

BACKGROUND OF THE INVENTION

The present invention relates to a printer for a rolled paper in which a printed rolled paper is cut away for ticket issue.

In a conventional printer for the rolled paper, in order to mount the paper on the printer, it is necessary to nip an end portion of the paper between a print head and a platen roller. In order to facilitate the nipping of the paper, the print head is provided on a printer body and the platen roller is attached on a cover.

FIGS. 10 and 11 show the conventional printer.

Referring to FIG. 10, a print head 112 and a movable blade 120*c* of a paper cutter are mounted on a printer body 101. A platen roller 116 for pressing the paper of a rolled paper 124 against the print head 112 and a fixed blade 120*b* to be engaged with the movable cutter 120*c* are mounted on a cover 105.

The rolled paper 124 is mounted on the printer body 101, and a paper end portion 124*a* is pulled out of a paper discharge opening 106, and then the cover 105 is rotated in the direction of an arrow F to close the printer body 101.

FIG. 11 shows the closed state. The paper 124 is nipped by the print head 112 and the platen roller 116, and the paper end portion 124*a* is pulled out of the paper discharge opening 106 passing through the gap between the fixed blade 120*b* and the movable blade 120*c*.

This printer has an advantage that the paper can be easily attached to the machine. However, since the print head and the platen roller are separately mounted on the cover and the print body, it is difficult to securely keep the contact of the print head with the platen roller. Since the fixed blade and the movable blade are separated, it is difficult to keep the engagement accuracy. Furthermore, since the fixed blade and the movable blade are positioned near the paper discharge opening, there is a danger of contacting and injuring of user's fingers when mounting the rolled paper. In addition, the print head is exposed when the cover is opened. As a result, if user's fingers contact with the print head, the fingers may have a burn.

The printer shown in FIGS. 12 and 13 is made to obviate the above described disadvantages and dangers.

Referring to FIG. 12, a cover 205 is pivotally mounted on a printer body 201. On the printer body 201, there is mounted a print head 212, a platen roller 216 pressed against the print head 212 for feeding paper 224, and a cutter 220 for cutting away the paper 224. The cutter 220 comprises a fixed blade 220*b* and a movable blade 220*c*. A paper inserting opening 220*a* is formed between the fixed and movable blades.

As shown in FIG. 12, the paper 224 is mounted on the printer body 201, a paper end portion 224*a* is inserted between the print head 212 and the platen roller 216 in the direction of an arrow ①, and the platen roller 216 is rotated in the direction of an arrow H to feed forward the paper, thereby inserting the paper end portion 224*a* in the paper inserting opening 220*a* of the cutter 220. The paper is further fed to be discharged from a paper discharge opening 206 as shown by an arrow ②, and the cover 205 is closed in the direction of an arrow G as shown in FIG. 13.

Although the printer resolves the problems of the printer of FIGS. 10 and 11, it is troublesome to set the paper in the printer.

SUMMARY OF THE INVENTION

An object of the present invention is to provide a printer in which the paper can be easily set without injuring the user's fingers.

According to the present invention, there is provided a printer having a printer body and a cover rotatably mounted on the printer body, comprising, a paper holding portion provided in the printer body for holding paper, a paper discharge opening formed between the printer body and the cover at a front portion of the printer, a paper cutter comprising a fixed blade and a movable blade and provided in the printer body adjacent the paper discharge opening, a print head provided in the printer body adjacent the paper cutter, a platen roller rotatably mounted on the printer body and contacted with the print head, a pressure roller rotatably mounted on the cover so as to be pressed against the platen roller when the cover is closed, the paper discharge opening, paper cutter, and platen roller being disposed so that the paper is pulled out from the paper discharge opening passing over the platen roller and between the fixed and movable blades.

The printer further comprises a return paper receiving space formed between the platen roller and the paper holding portion.

A paper set detector is provided adjacent the print head, and a control circuit is provided for receiving a paper set signal from the paper set detector and for starting the platen roller rotating in the paper return direction so as to return the paper nipped between the platen roller and the pressure roller.

These and other objects and features of the present invention will become more apparent from the following detailed description with reference to the accompanying drawings.

DETAILED DESCRIPTION OF THE PREFERRED EMBODIMENT

Figure 1:
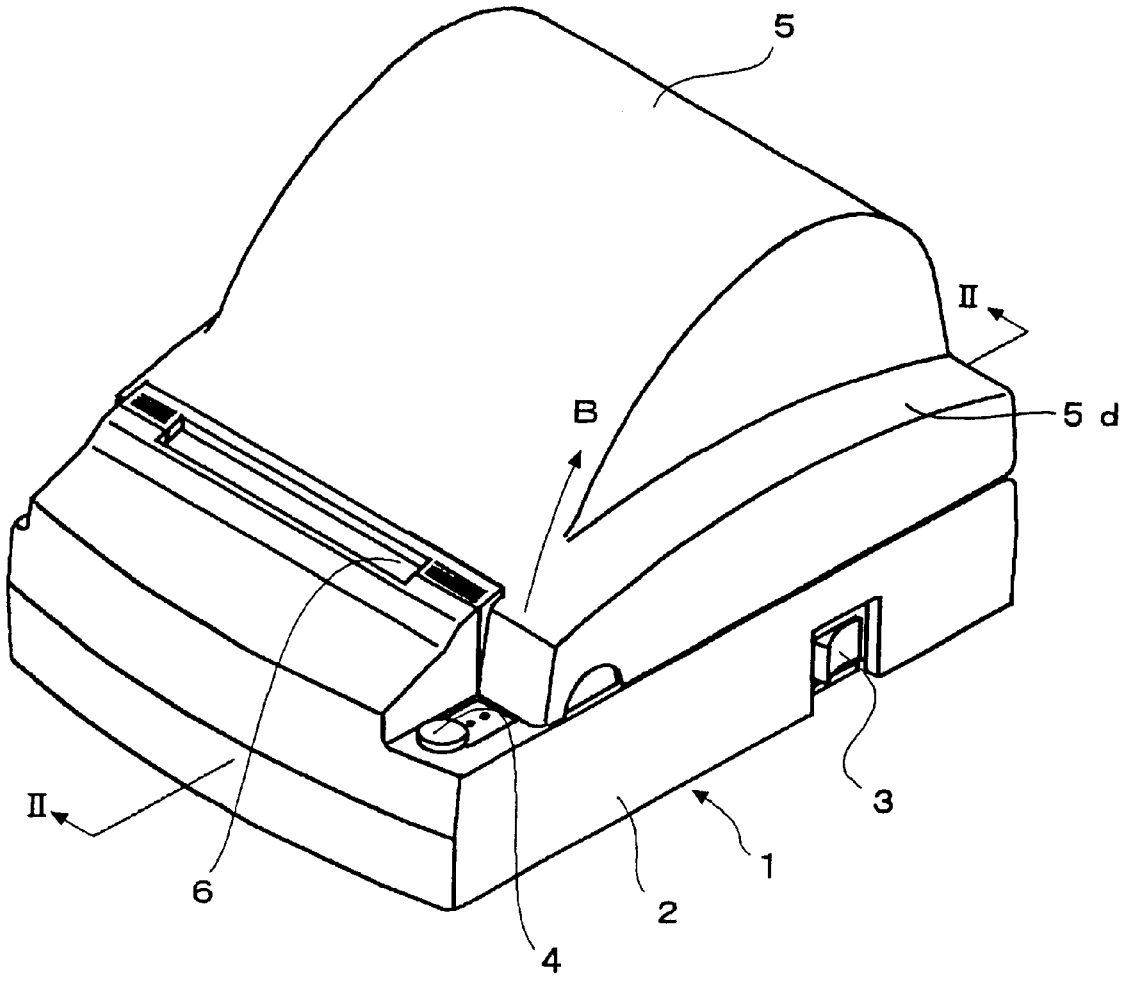
FIG. 1 is a perspective view showing a printer according to the present invention.

Referring to FIG. 1, a cover 5 is pivotally mounted on a printer body at a rear portion thereof so as to be opened in the direction of an arrow B. The printer body 1 is covered by a body cover 2 and provided with a power switch 3 and a paper feed button 4.

Figure 2:
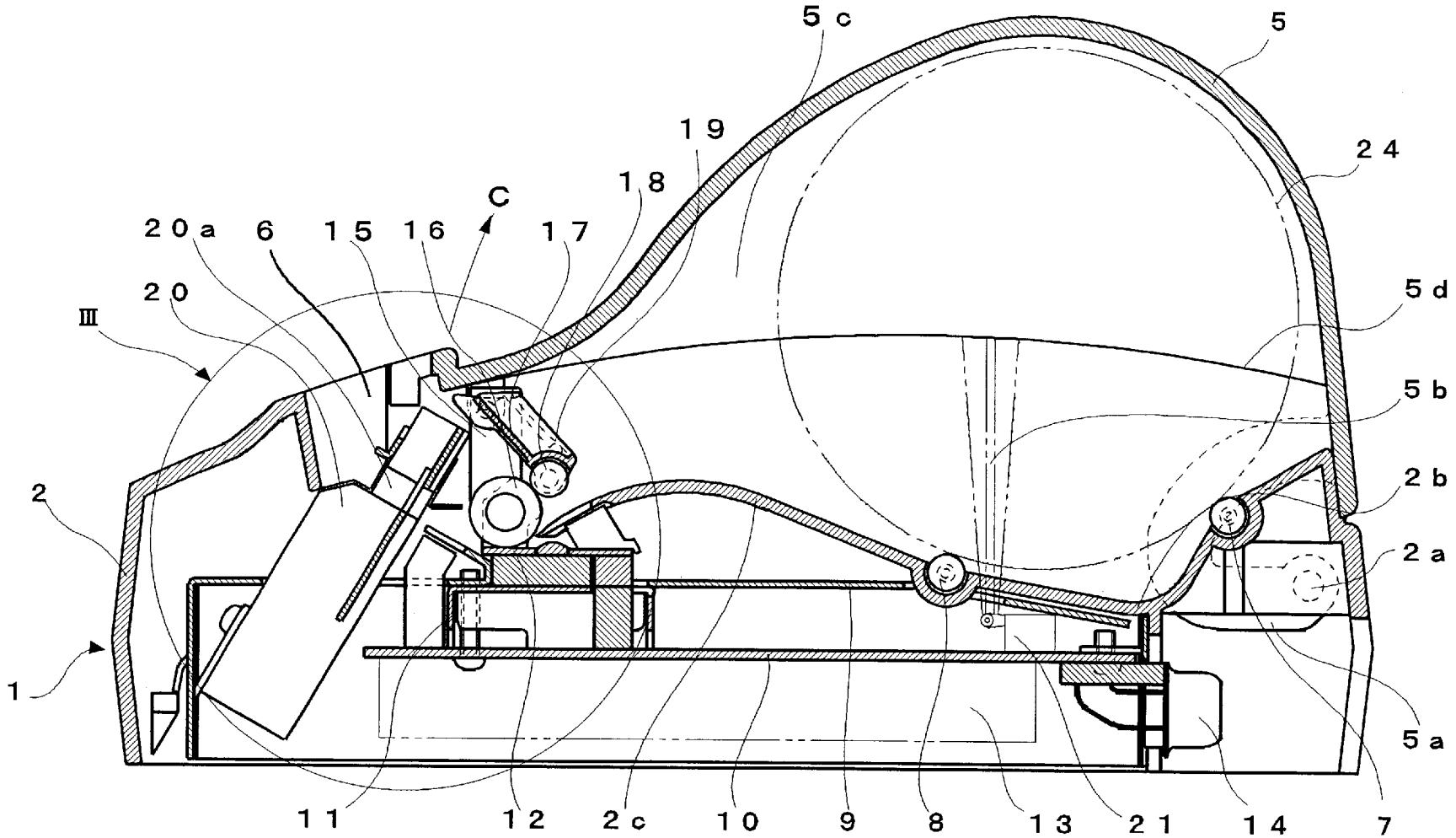
FIG. 2 is a sectional view taken along a II—II line of FIG. 1.
Figure 3:
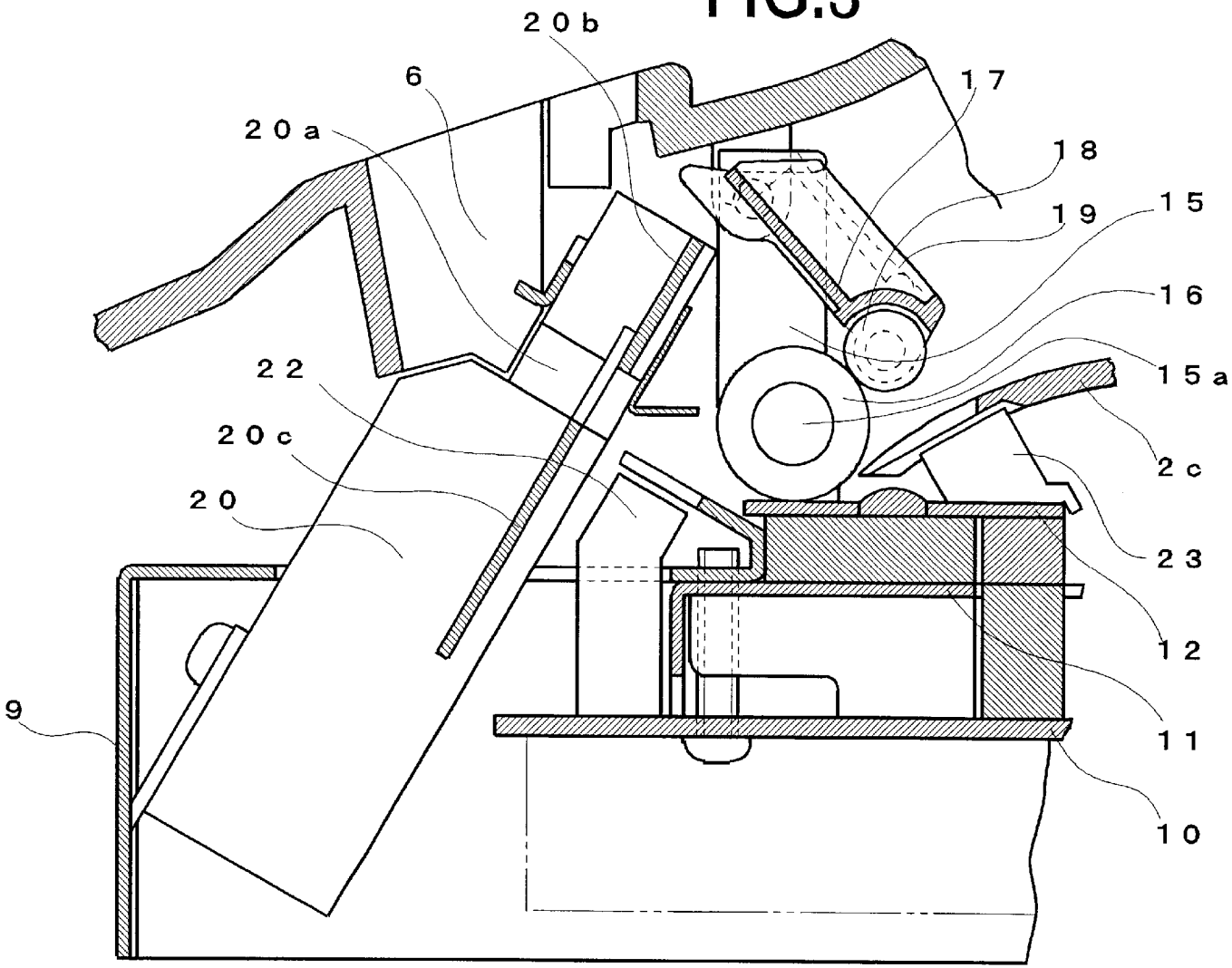
FIG. 3 is an enlarged sectional view of a part shown by III in FIG. 2.

Referring to FIGS. 2 and 3, the cover 5 is rotatably supported on a pin 2*a* of the body cover 2 at an arm 5*a*. The body cover 2 has a paper holding portion 2*b* and a paper course 2*c* adjacent the paper holding portion 2*b*. A paper discharge opening 6 is formed between the body cover 2 and the cover 5.

A pair of paper supporting rollers 7 and 8 are rotatably mounted in the paper holding portion 2*b* for supporting a rolled paper 24. The paper course 2*c* is upwardly curved so as to guide the paper to a print head.

Under the body cover 2, a frame 9 having a circuit substrate 10 is provided. On the underside of the circuit substrate 10, a control circuit 13 is installed. A print head frame 11 is mounted on the circuit substrate 10. A thermal print head 12 is mounted on the print head frame 11 and connected to the control circuit 13.

Referring to FIG. 3, a platen roller 16 is rotatably mounted on a shaft 15*a* secured to a platen roller holder 15 and pressed against the print head 12 by a pressure roller 18 as described hereinafter.

There is provided a cover close detector 21 on the circuit substrate 10 for detecting the closing of the cover 5, and a paper end detector 22 (FIG. 3) of the light reflection type for detecting the end of the paper end portion 24*a* nipped by the platen roller 16 and the print head 12, and a paper set detector 23 above the print head frame 11 for detecting the paper 24 set on the paper course 2*c*. Those detectors 21, 22 and 23 are connected to the control circuit 13.

As shown in FIG. 3, there is formed a paper inserting opening 2*a* adjacent the paper discharge opening 6. A paper cutter 20 is provided in a front portion of the body frame 9. The paper cutter 20 comprises a movable blade 20*c* and a fixed blade 20*b* provided at opposite sides of the opening 20*a*.

As shown in FIG. 2, the cover 5 is upwardly expanded so as to cover the rolled paper 24. In front of the rolled paper 24, a return paper receiving space 5*c* is formed. A detector operating means 5*b* is downwardly projected from an inner wall of a shoulder 5*d* (FIG. 1) of the cover 5 so as to operate the cover close detector 21.

Referring to FIG. 3, a pressure roller holder 17 is pivotally mounted on the inside wall of the cover 5, and the pressure roller 18 is rotatably mounted on the holder 17. A pressure roller urging member 19 is provided so as to press the pressure roller 18 against the platen roller 16.

Paper setting operation will be described hereinafter with respect to FIGS. 4–9.

Figure 4:
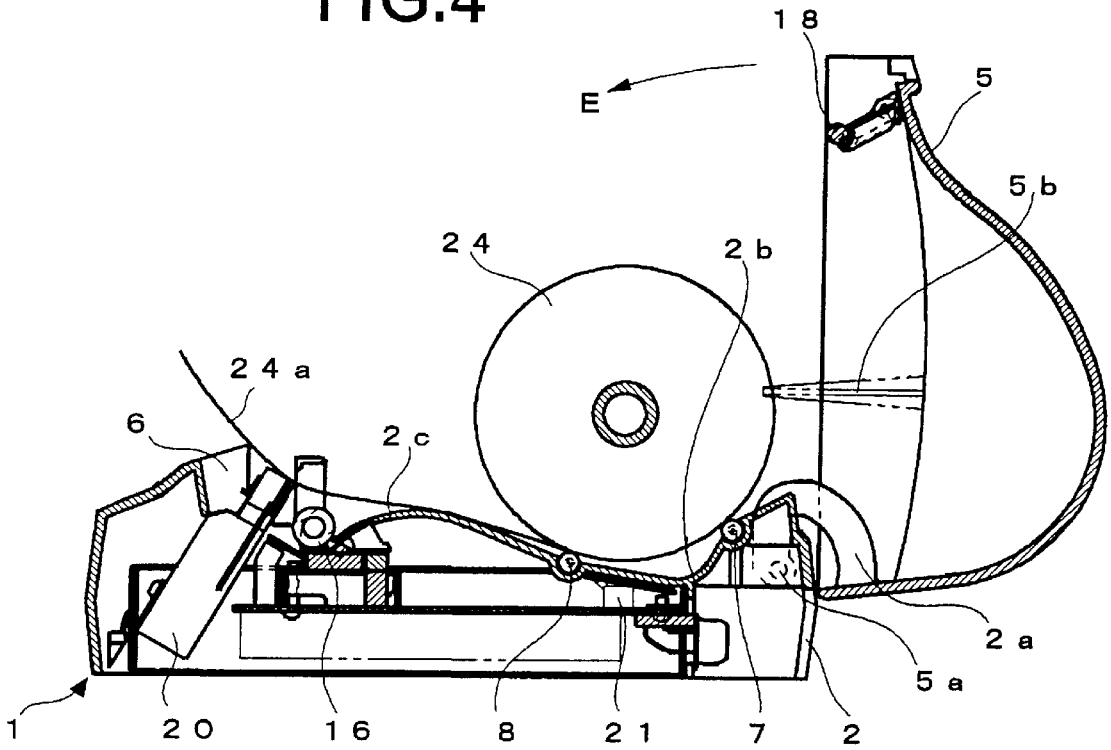
FIG. 4 is a sectional view of the printer where a cover is opened.
Figure 5:
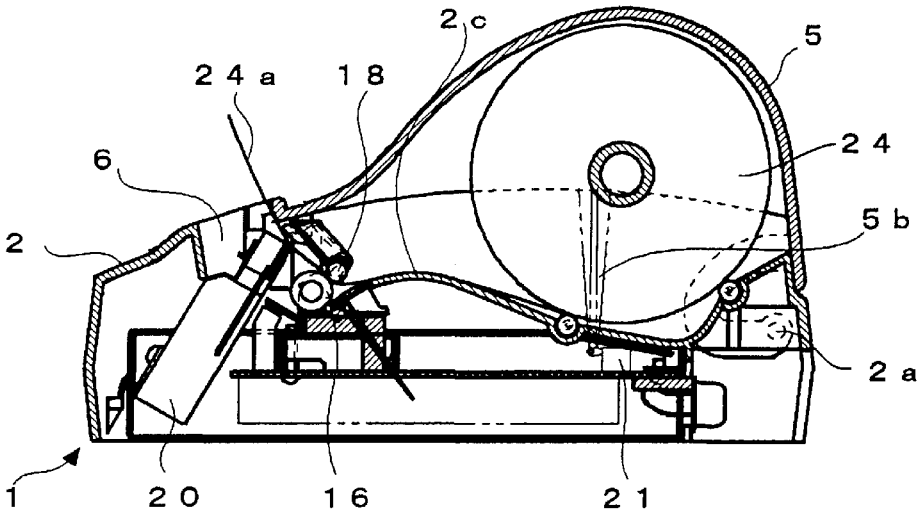
FIG. 5 is a sectional view of the printer where the cover is closed.

As shown in FIG. 4, the cover 5 is opened, and the rolled paper 24 is put on the paper holding rollers 7 and 8. The end portion 24*a* of the paper is pulled out passing through the platen roller 16 and the paper discharge opening 6, and extended, then the cover 5 is closed.

When the cover 5 is closed, the paper 24 is nipped by the platen roller 16 and the pressure roller 18, and the cover close detector 21 detects the closing of the cover, so that a cover close signal is fed to the control circuit 13.

On the other hand, the paper set detector 23 (FIG. 3) detects the setting of the paper near the print head 12, feeding a paper set signal to the control circuit 13.

Figure 6:
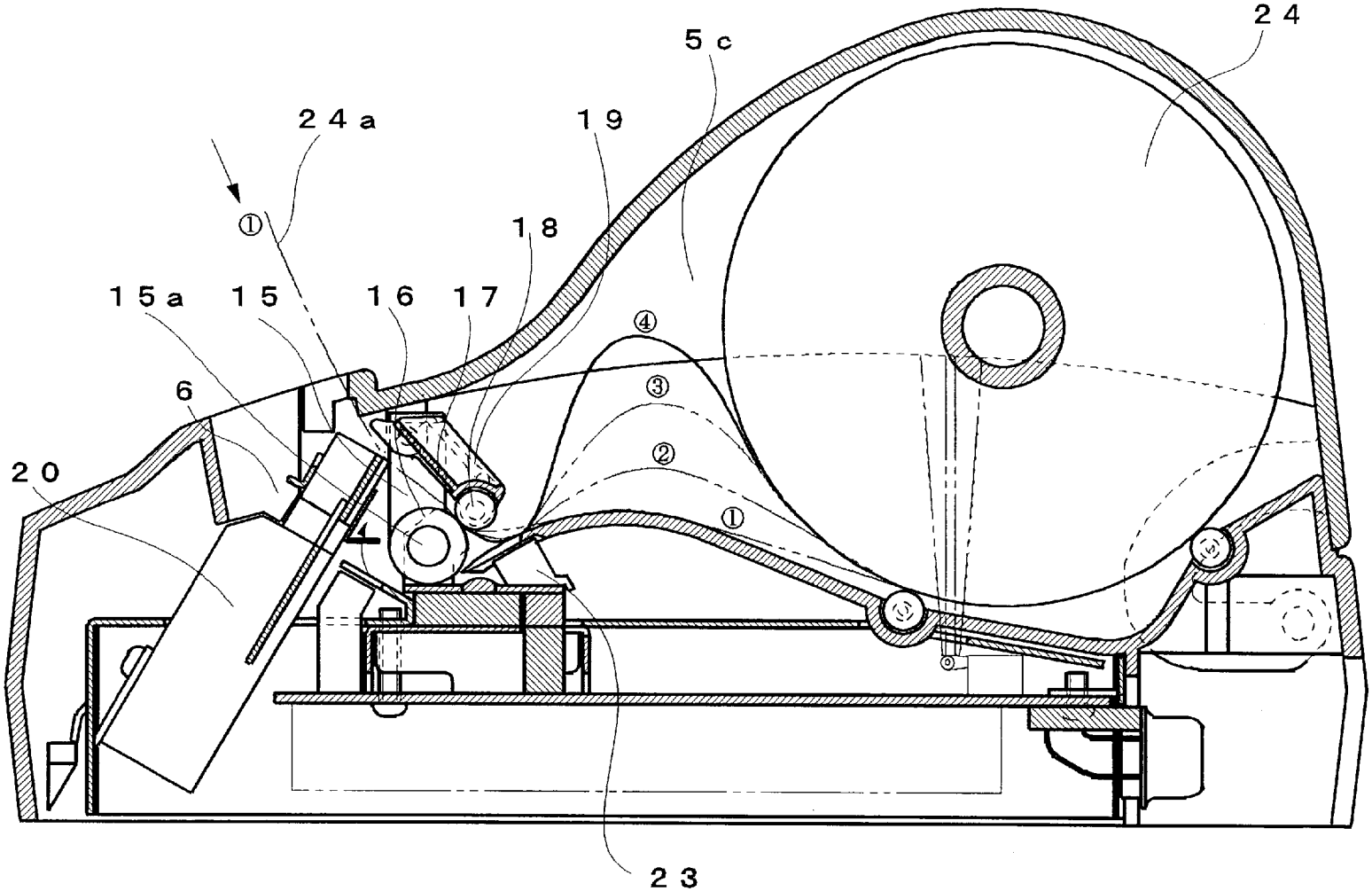
FIGS. 6 through 8 are sectional views showing the operation of the printer.

In response to the cover close signal and the paper set signal, the control circuit 13 causes the platen roller 16 to rotate in the clockwise direction (arrow F in FIG. 6), thereby returning the paper end portion 24*a* from the position ① of FIG. 6 in the direction of an arrow. The returned paper expands in the space 5*c* in the order of②,③,④. As a result, the resilient force toward the platen roller 16 is accumulated in the bent paper.

Figure 7:
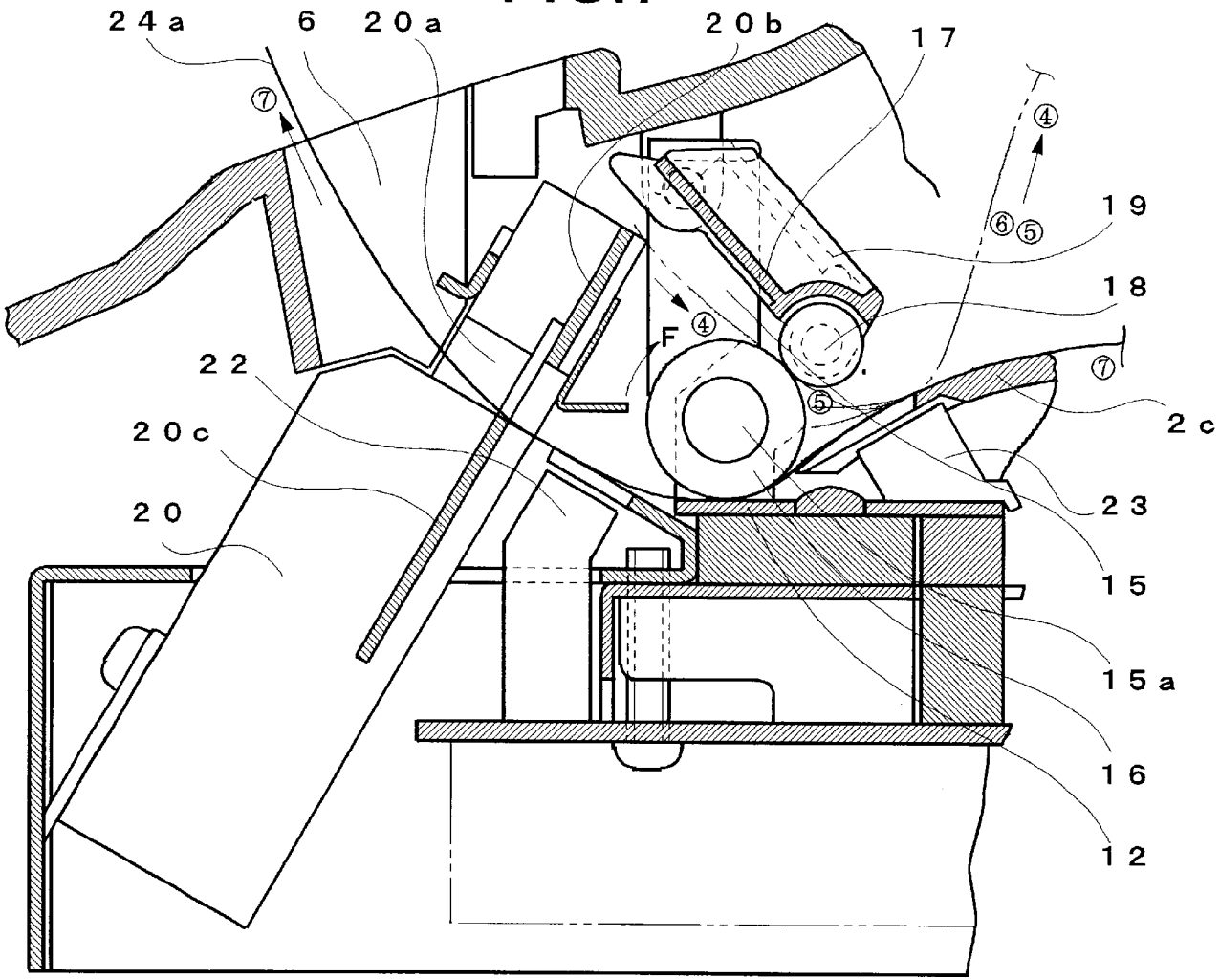
Figure 8:
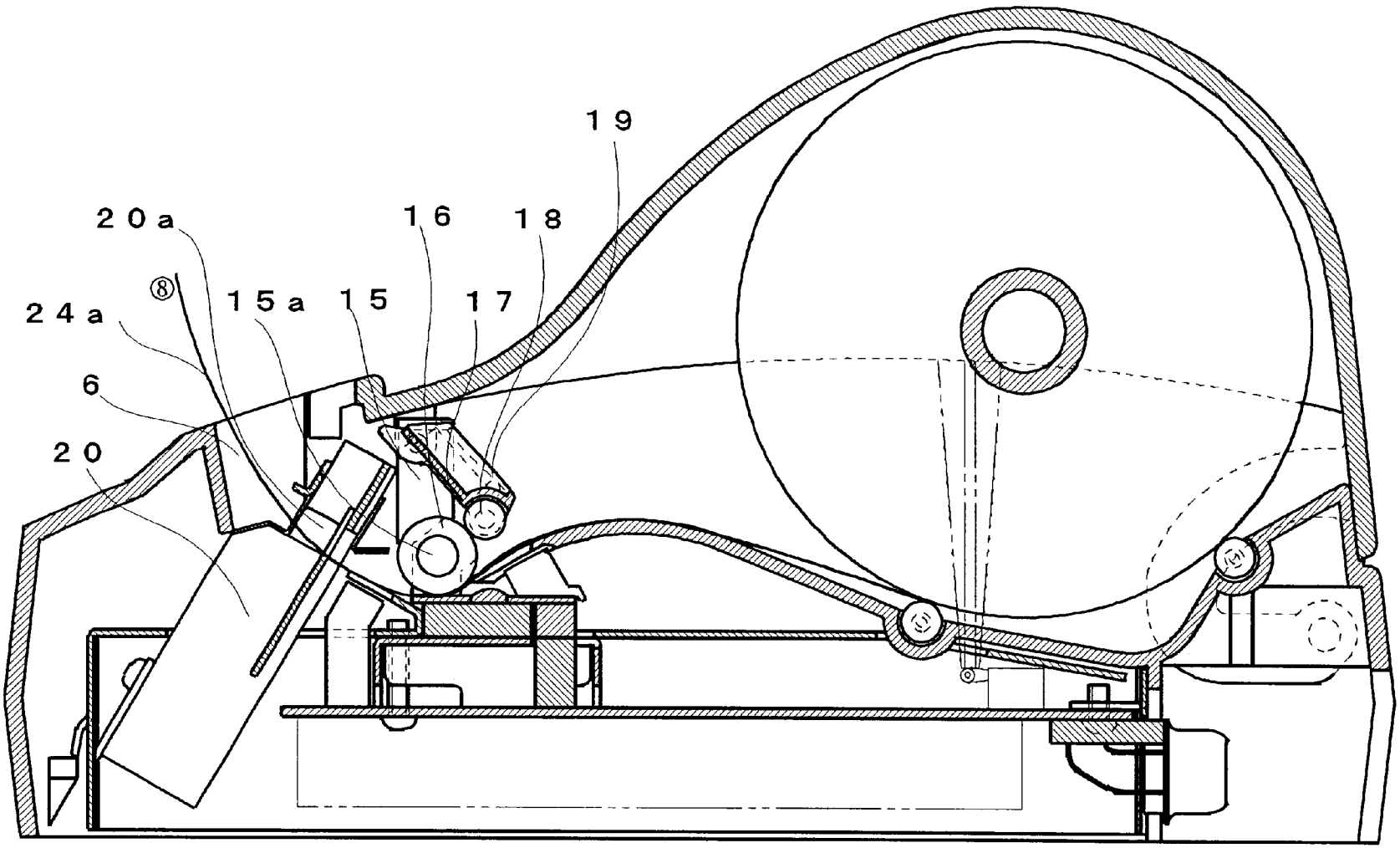

When the paper removes from the platen roller 16 and the pressure roller 18, the paper end is pressed against the platen roller by the accumulated resilient force, as shown by lines ⑤, ⑥ in FIG. 7.

Figure 9:
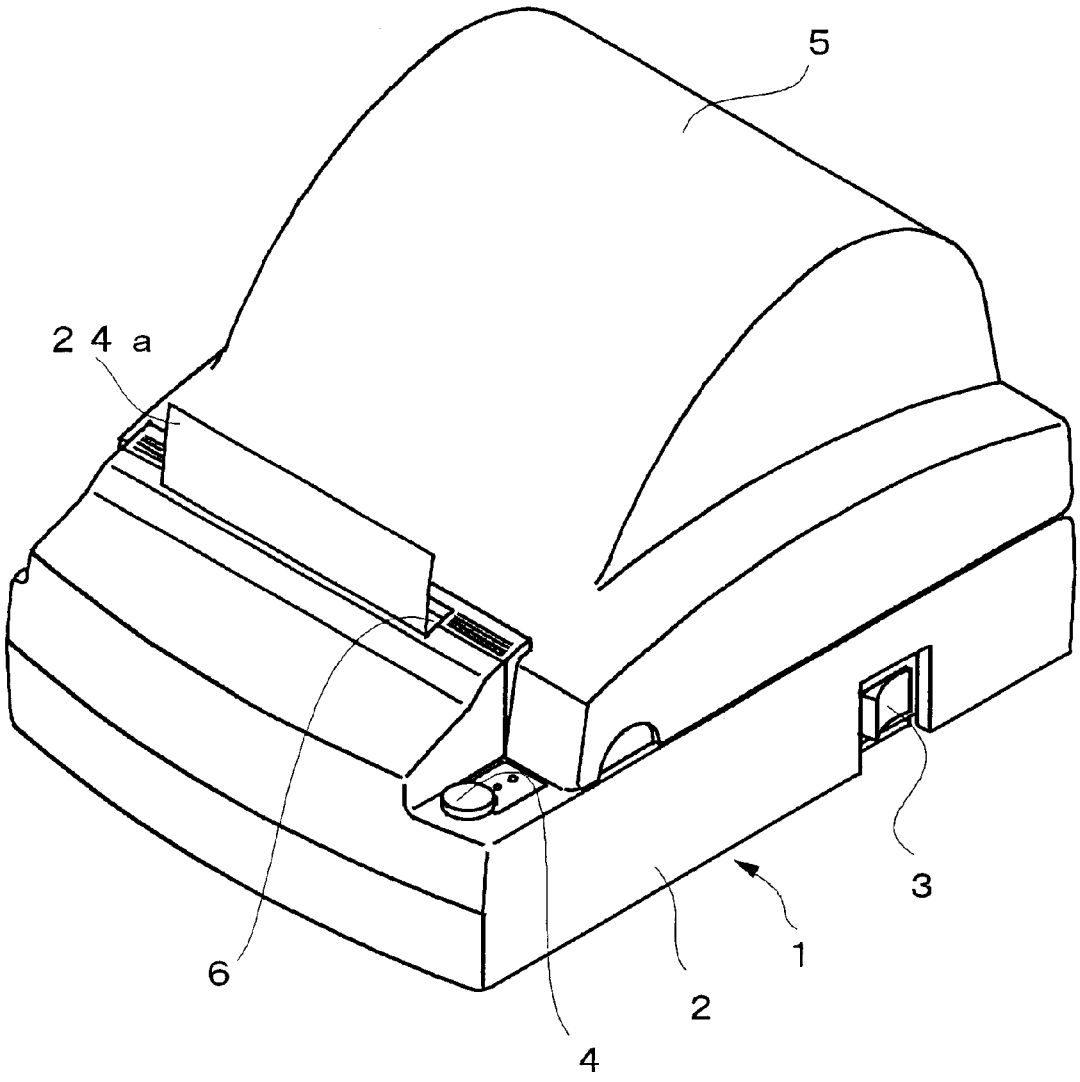
FIG. 9 is a perspective view showing the state of FIG. 8.
Figure 10:
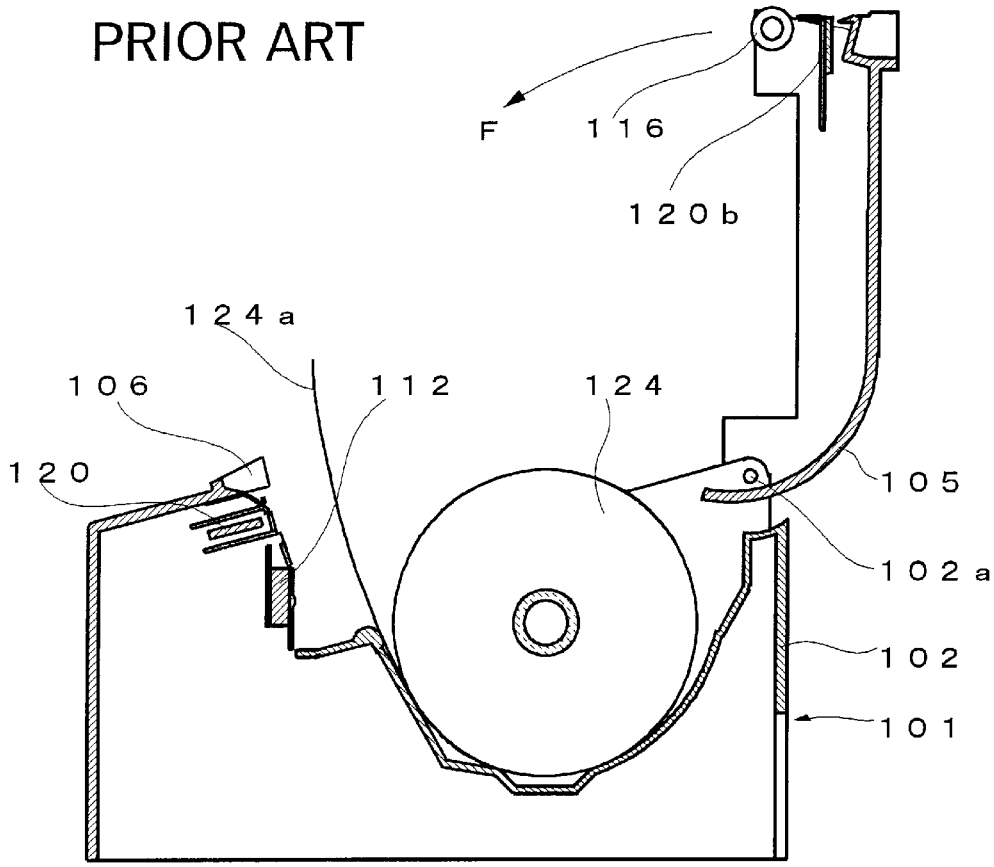
FIG.10 PRIOR ART
FIGS. 10 and 11 are sectional views of a conventional printer.
Figure 11:
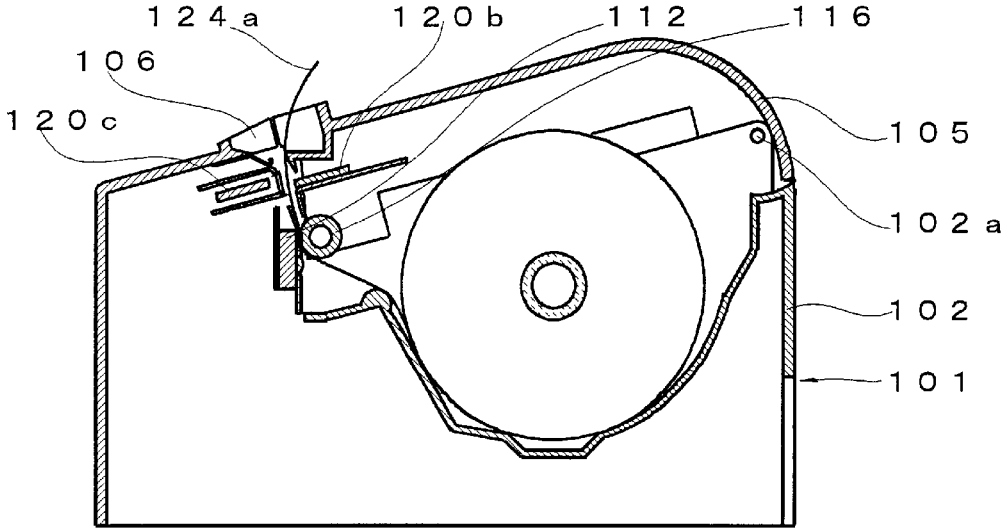
FIG.11 PRIOR ART
Figure 12:
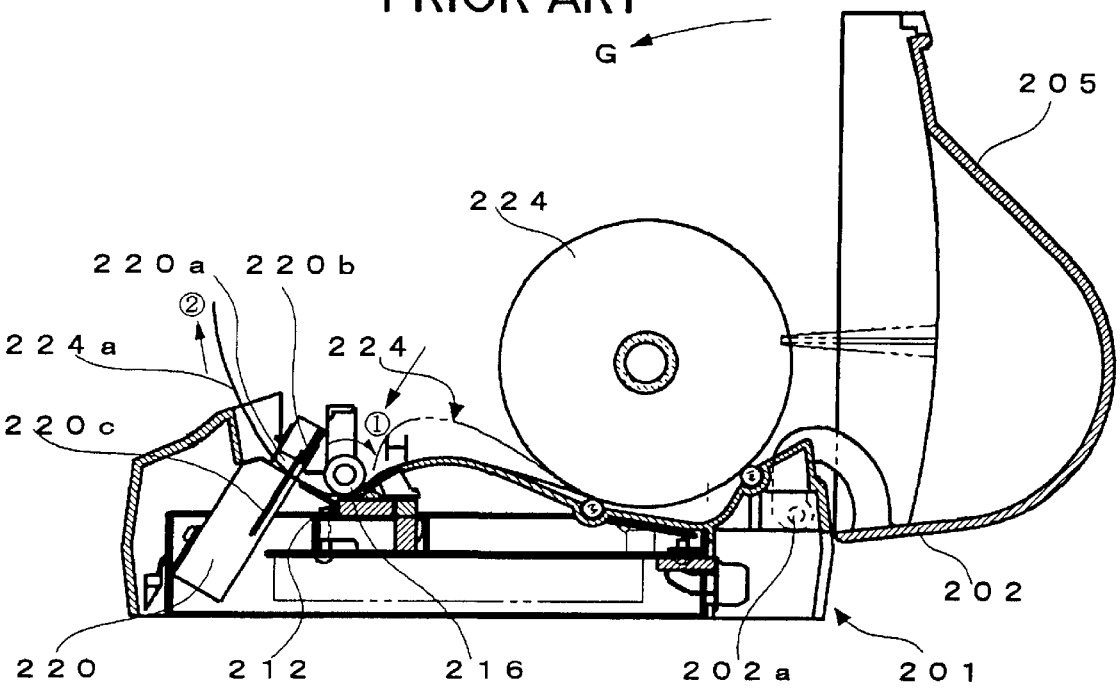
FIG.12 PRIOR ART
FIGS. 12 and 13 are sectional views of another conventional printer.
Figure 13:
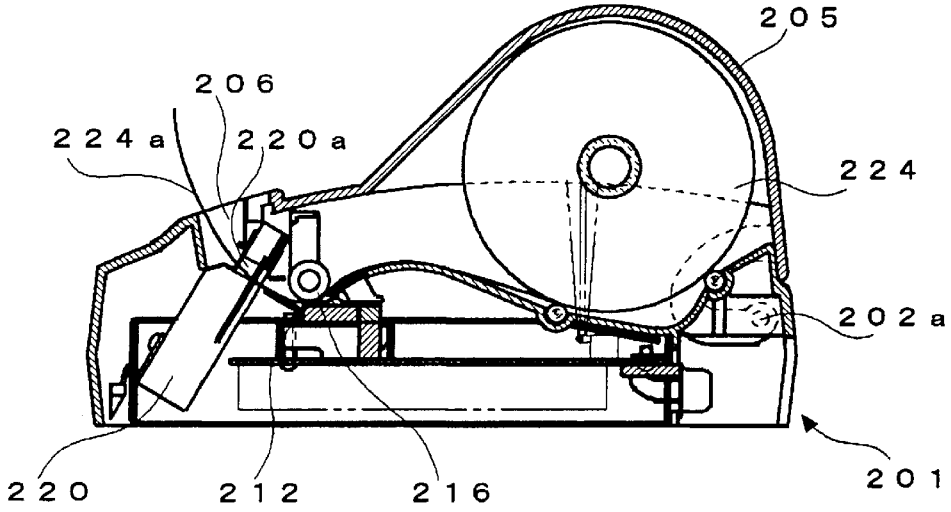
FIG.13 PRIOR ART

Therefore, the end of the paper is introduced in space between the platen roller 16 and the print head 12 by the rotation of the platen roller and nipped by the roller 16 and the head 12. Thus, the paper is fed by the rotation of the platen roller 16. When the end of the paper reaches the paper end detector 22, the paper set detector sends a paper end detect signal to the control circuit 13. The control circuit 13 starts to count the paper feed quantity from the time of receiving of the paper end detect signal. The paper is fed passing through the paper insert opening 20*a* as shown by ⑦ in FIG. 7. When the paper is fed a predetermined quantity from the start of the counting, the platen roller 16 is stopped. Thus, the paper stops at a predetermined length as shown by ⑧ in FIG. 8. FIG. 9 shows the printer in the state of FIG. 8.

As another embodiment of the present invention, there is a printer where the paper end detector 22 is omitted.

Explaining the paper setting operation of the embodiment, the operation from FIG. 4 to FIG. 7 is the same as the above described operation. Hence the description thereof is omitted.

The platen roller 16 is stopped when the roller is rotated a predetermined number of rotation from the start of the rotation.

In accordance with the present invention, the paper is automatically introduced between the platen roller and the print head in the cover closed state. Therefore, the paper can be easily set in the printer. Namely, the problems of the conventional printers are perfectly resolved by the present invention.

While the invention has been described in conjunction with preferred specific embodiment thereof, it will be understood that this description is intended to illustrate and not limit the scope of the invention, which is defined by the following claims.

What is claimed is:

1. A printer having a printer body (1) and a cover (5) rotatably mounted on the printer body, comprising:

a paper holding portion (2*b*) provided in the printer body for holding a rolled paper (24);

a paper discharge opening (6) formed between the printer body and the cover at a front portion of the printer;

a paper cutter (20) having a movable blade (20*c*) and a fixed blade (20*b*) and provided in the printer body adjacent the paper discharge opening;

a print head (12); and, a platen roller (16) rotatably mounted on the printer body and contacted with the print head;

wherein, the print head is provided in the printer body adjacent the paper cutter;

a pressure roller (18) is rotatably mounted on the cover so as to be pressed against the platen roller at an upper periphery of the platen roller when the cover is closed;

the pressure roller is disposed so that paper pulled out from the rolled paper is mounted on the platen roller when the cover is opened and the paper is nipped by the pressure roller and the platen roller when the cover is closed;

a return paper guide portion (2*c*) is provided behind the platen roller so as to guide a return paper returned by rotation of the platen roller in a paper feeding direction so that the returned paper is upwardly expanded, and that an end of the returned paper falls and is introduced between the platen roller and the print head by elastic force accumulated in the upwardly expanded paper when the end of the returned paper disengages from the platen roller;

the paper discharge opening, paper cutter, and platen roller are disposed so that the paper is discharged from the paper discharge opening passing over the platen roller and between the fixed and movable blades.

2. The printer according to claim 1 further comprising a return paper receiving space formed between the platen roller and the paper holding portion.

3. The printer according to claim 1 further comprising a paper set detector provided adjacent the print head, and a control circuit for receiving a paper set signal from the paper set detector and for starting the platen roller rotating in the paper return direction so as to return the paper nipped between the platen roller and the pressure roller.

4. The printer according to claim 1 further comprising resilient means provided on the cover for urging the pressure roller to the platen roller.

5. The printer according to claim 1 wherein the paper is a rolled paper.

6. The printer according to claim 1 wherein the cutter comprises a fixed blade and a movable blade.

* * * * *